US006551115B1

(12) United States Patent
Li et al.

(10) Patent No.: US 6,551,115 B1
(45) Date of Patent: Apr. 22, 2003

(54) POWER JACK WITH CENTRAL PIN

(75) Inventors: Pengtei Li, Kunsan (CN); Lunsong Hu, Kunsan (CN); ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/062,893

(22) Filed: Jan. 30, 2002

(30) Foreign Application Priority Data

Dec. 26, 2001 (TW) ..... 90223016

(51) Int. Cl.[7] ..... H01R 9/09
(52) U.S. Cl. ..... 439/79; 200/51.1; 439/947
(58) Field of Search ..... 439/188, 668, 439/733.1, 63, 947; 200/51.1

(56) References Cited

U.S. PATENT DOCUMENTS 3,579,178 A * 5/1971 Travis ..... 439/389
5,007,851 A * 4/1991 Matsumoto ..... 439/188
6,276,951 B1 * 8/2001 Chen et al. ..... 439/327
6,382,999 B1 * 5/2002 Mou et al. ..... 439/188

* cited by examiner

*Primary Examiner*—Lynn Field
*Assistant Examiner*—Phuong KT Dinh
(74) *Attorney, Agent, or Firm*—Wei Te Chung

(57) ABSTRACT

A power jack includes an insulating housing (1) having a plug insertion hole (12), a central pin (2) received in the plug insertion hole, and a first switch contact (3) and a second switch contact (4) secured in the housing. The central pin is integrally stamped and configured from a metal sheet, which has a hollow column-shaped contacting section (21), a hollow cuboid-shaped soldering section (22) extending downwardly, and an intermediate section (23) connecting therebetween. The central pin has two wings (231) extending from opposite sides of the intermediate section and being retained in a corresponding pair of slots (131) defined in the housing.

13 Claims, 8 Drawing Sheets

POWER JACK WITH CENTRAL PIN

BACKGROUND OF THE INVENTION

1. Field of the Invention

The present invention relates to a power jack, and particularly to a power jack having an improved central pin.

2. Description of Prior Art

FIGS. 9 and 10 illustrate two kinds of central pins 80, 90 used in two respective conventional power jacks 8, 9. The first kind of central pin 80 shown in FIG. 9 has a tapered front end 801, an intermediate enlarged portion 802, and a rear end portion 803 hollowed into a cylindrical configuration. A terminal 82, having a hole defined therethrough for insertion of the rear end portion 803 of the central pin 80 and a leg 821 extending downwards for engaging with a corresponding printed circuit board, is crimped onto such first kind of central pin 80, thereby establishing an electrical connection between a mating plug and the printed circuit board. However, the central conductive part of the power jack 8 being composed of the central pin 80 and the terminal 82 not only complicates the assembly process but also increases the manufacturing cost.

The second kind of central pin 90, as shown in FIG. 10, is configured in a solid column shape, and comprises a front portion 901 and a rear portion 902 extending downwards from a bent-out end 903 of the front portion 901. Such kind of central pin 90 is obtained by a multi-axis forming method, whereby the manufacture reliability cannot be ensured and the manufacture cost is unavoidably increased.

Hence, a power jack having an improved central pin is required to overcome the disadvantages of the prior art.

BRIEF SUMMARY OF THE INVENTION

The object of the present invention is to provide a power jack having an improved central conductive pin, the manufacture cost of which is reduced and the manufacture reliability of which is improved.

In order to achieve the above-mentioned object, a power jack in accordance with the present invention includes an insulating housing, a central conductive pin accommodated in the insulating housing, a first switch contact and a second switch contact respectively secured in the insulating housing beside the central conductive pin. The insulating housing defines a plug insertion hole through a front face, an upper recess and a lower recess separately in an upper side and a lower side of a rear face thereof. An elongated cavity and a pair of slots at opposite sides of the elongated cavity are defined in the insulating housing and in communicate with the upper recess. An elongated chamber is defined between side walls and in communication with the lower recess. The first switch contact is substantially received in the elongated chamber, and comprises a base portion and a resilient portion extending backwards from a front edge of the base portion. The second switch contact is partially received in the elongated chamber and electrically contacts with the first switch contact prior to insertion of a mating plug and from the first switch contact after insertion of the mating plug. The central conductive pin is integrally stamped and has a contacting section configured as a hollow column, a soldering section configured as a hollow cuboid and extending downwards, and an intermediate section connecting the contacting section with the soldering section. A pair of wings are formed oppositely on the intermediate section of the central conductive pin. The central conductive pin is received in the elongated cavity, the central axis of which is in alignment with that of the plug insertion hole for correctly and properly cooperating with the mating plug.

Other objects, advantages and novel features of the invention will become more apparent from the following detailed description of the present embodiment when taken in conjunction with the accompanying drawings.

BRIEF DESCRIPTION OF THE DRAWINGS

FIG. 4 is a back plan view of the power jack shown in FIG. 3;

DETAILED DESCRIPTION OF THE INVENTION

Figure 1:
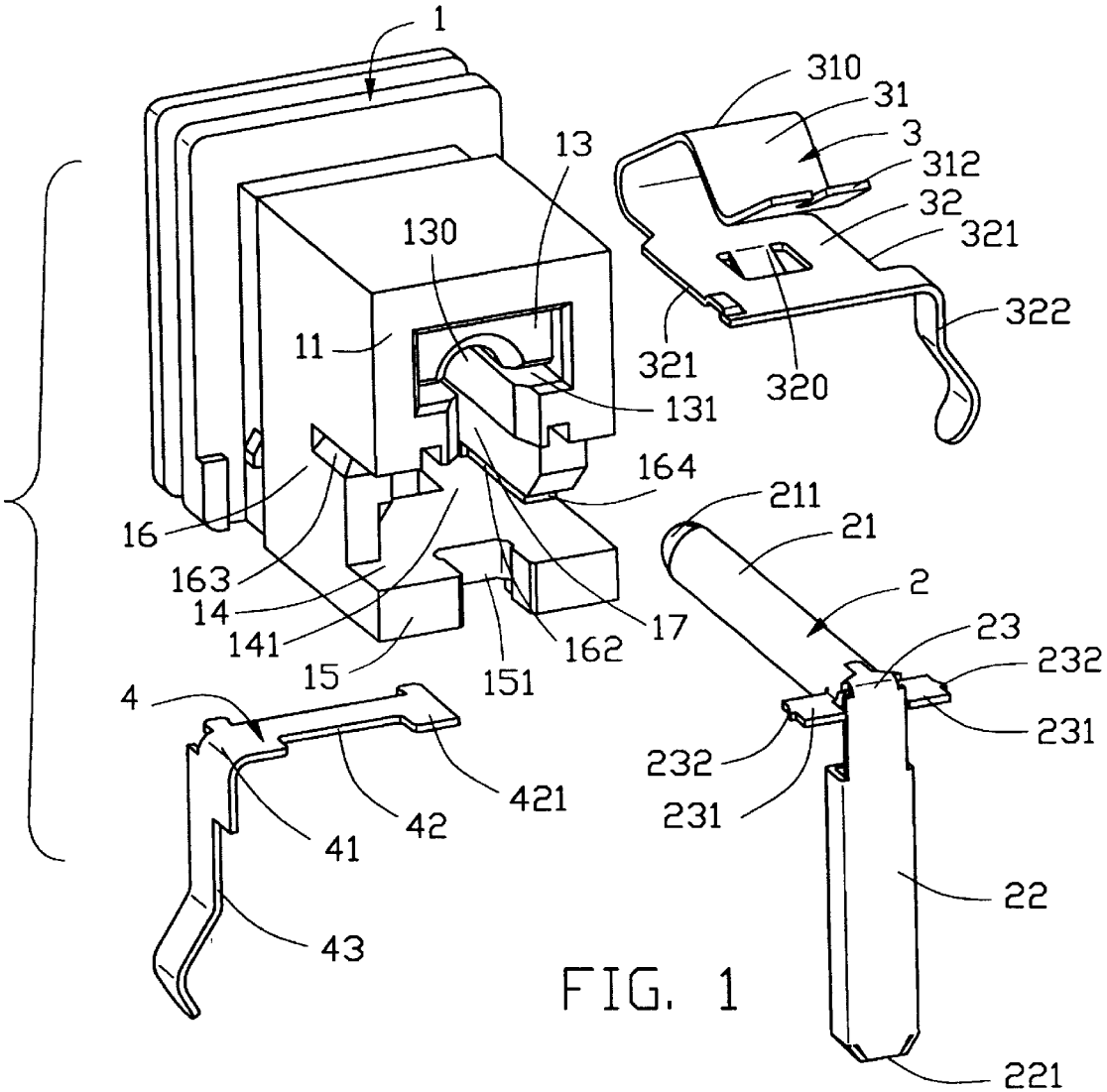
Figure 2:
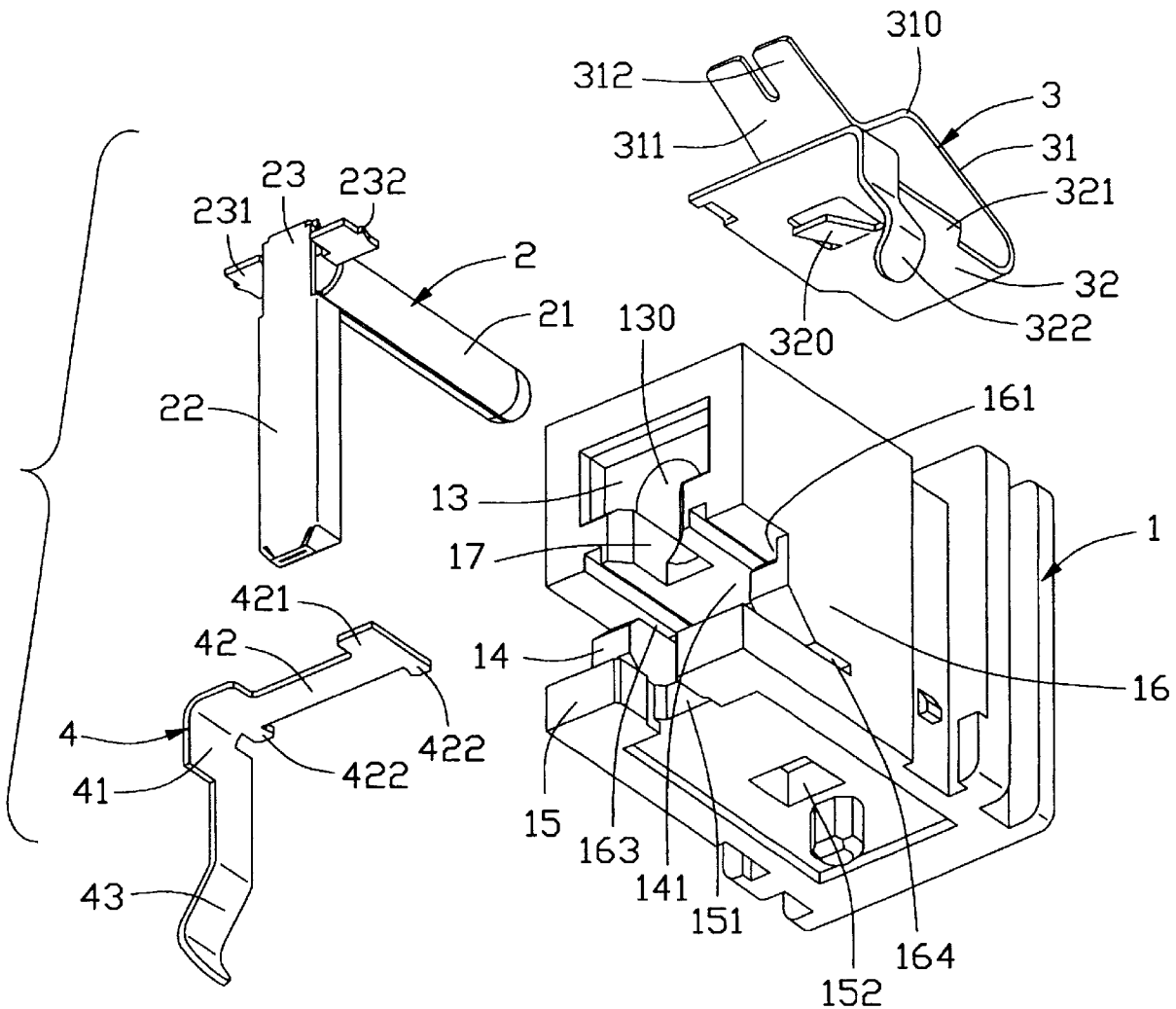
FIG. 2 is a view similar to FIG. 1, but taken from a different angle.
Figure 3:
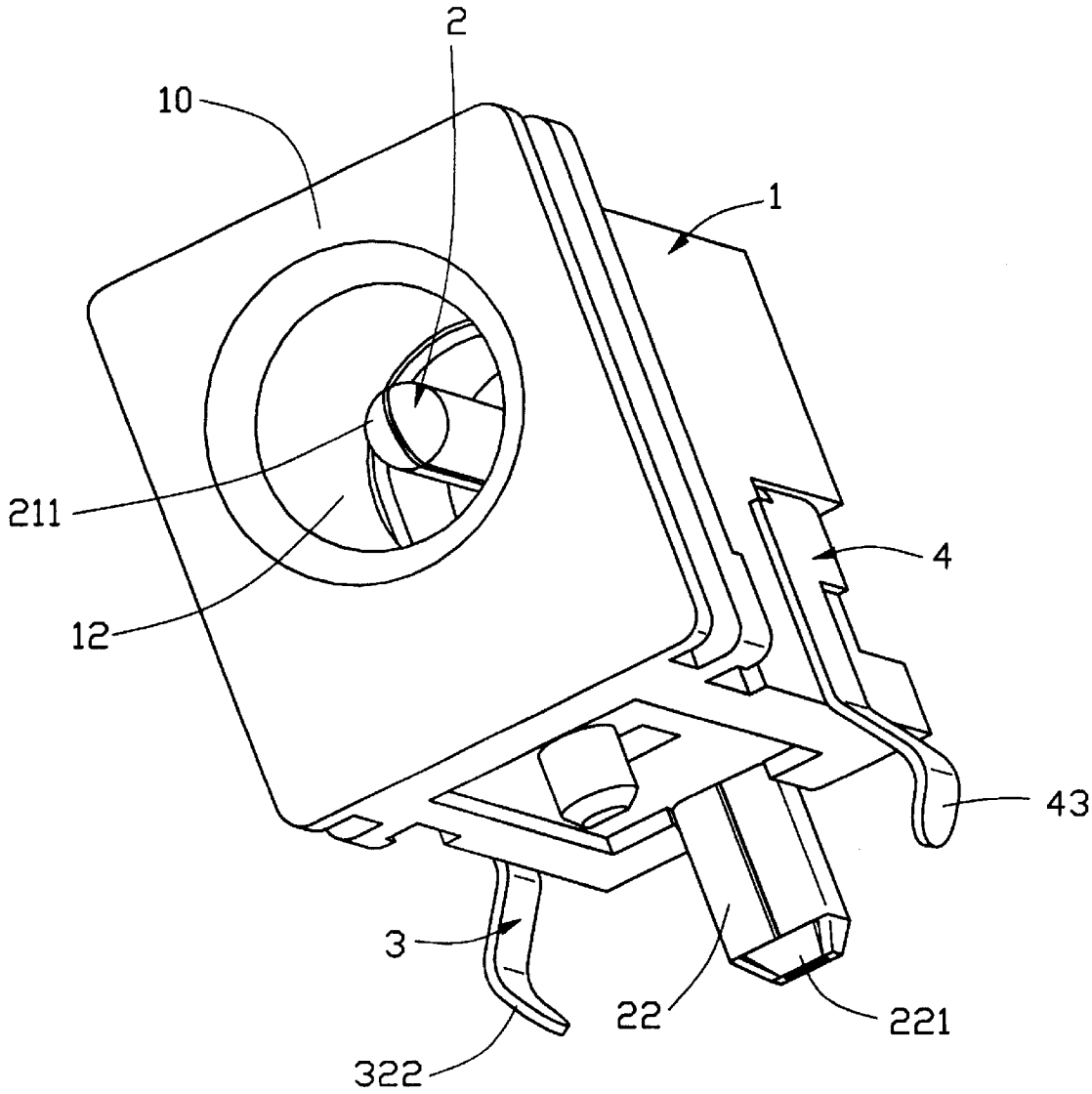
FIG. 3 is an assembled perspective view of the power jack shown in FIG. 1.
Figure 4:
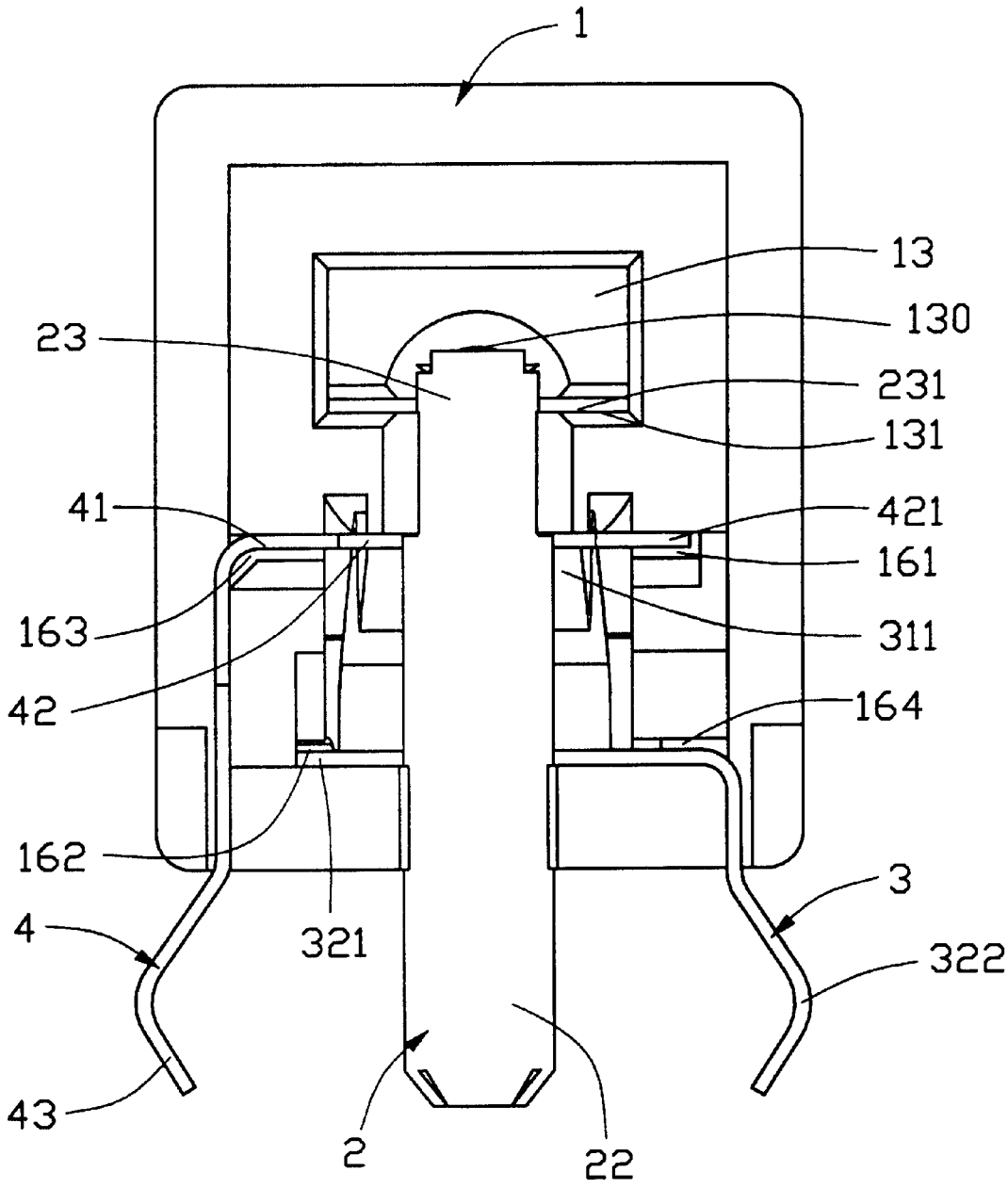
FIG.4 is an exploded, perspective view of a power jack in accordance with the present invention.

As shown in FIG. 1, a power jack in accordance with the present invention includes an insulating housing 1, a central conductive pin 2 accommodated in the insulating housing 1, a first switch contact 3 and a second switch contact 4 located in the insulating housing 1 beside the central conductive pin 2.

Referring to FIGS. 1–4, the insulating housing 1 defines a plug insertion hole 12 through a front face 10 thereof, an upper rectangular recess 13 in a rear face 11 thereof, and a lower recess 14 in the rear face 11. A groove 17 is defined between and communicates with the upper recess 13 and the lower recess 14. An elongated cavity 130 is defined in front of the upper rectangular recess 13 and communicates the upper rectangular recess 13 with the plug insertion hole 12. At a bottom side of the rectangular recess 13, a pair of slots 131 are defined oppositely. The insulating housing 1 also has an elongated chamber 141 defined in a longitudinal direction between two sidewalls 16 thereof and communicating with the lower recess 14. The two sidewalls 16 respectively define an upper cutout 163 and a slit 161 extending inwards a predetermined distance. The cutout 163 and the slit 161 are in communication with the elongated chamber 141 horizontally and in communication to the lower recess 14 longitudinally. A pair of channels 162 are oppositely defined in the inner surfaces of the sidewalls 16 under corresponding upper cutout 163 and slit 161. A lower cutout 164 is defined in one sidewall 16 opposite to the other one in which the upper cutout 163 is defined, and communicates with the channel 162 in the same sidewall. A rectangular groove 151 is defined in a rear side of a bottom wall 15 of the insulating housing 1 for receiving corresponding part of the central conductive pin 2, which will be detailed hereinafter. The bottom wall 15 of the insulating housing 1 also defines a rectangular hole 152 in a middle thereof.

The first switch contact 3, which is substantially received in the elongated chamber 141, comprises a base portion 32 and a resilient portion 31 extending rearwards from a front edge of the base portion 32. The resilient portion 31 has an inverted V-shaped portion 310 and a contacting portion 311 formed at a free end thereof with a pair of contacting fingers 312 projecting therefrom. A pair of retaining portions 321 horizontally protrude from opposite sides of the base portion 32 for being received in corresponding channels 162 to secure the first switch contact 3 in the insulating housing 1. The base portion 3 also has a resilient tab 320 stamped therefrom for being retained in the rectangular hole 152 of the insulating housing 1. A retaining leg 322 extends downwards from a lateral rear edge of the base portion 32 for being inserted into a corresponding hole of a printed circuit board (not shown).

The second switch contact 4 is configured in an approximate L-like shape, and includes a contacting arm 42, a retaining leg 43 extending vertically from the contacting arm 42, and a bent-out transition portion 41 formed therebetween. The contacting arm 42 has an enlarged portion 421 formed at a free end thereof for engaging with the slit 161 of the insulating housing 1. A pair of lugs 422 protrude from a front edge of the contacting arm 42 for being received in corresponding cavities (not shown) defined in the sidewalls 16 in communication with respective upper cutout 163 and the slit 161 to secure the second switch contact 4 therein.

The central conductive pin 2 of the present invention includes a contacting section 21 configured in a hollow column, a soldering section 22 configured in a hollow cuboid perpendicular to the contacting section 21, and an intermediate section 23 interconnecting the contacting section 21 with the soldering section 22. A pair of opposite wings 231 project horizontally from a front end of the intermediate section 23 and are received in corresponding slots 131 of the insulating housing 1. Each wing 231 forms a barb 232 on a lateral edge thereof for interference with an outer sidewall of the corresponding slot 131. The central conductive pin 2 further comprises a round contacting end 211 at a free end of the contacting section 21 and a tapered soldering end 221 at a free end of the soldering section 22.

Figure 7:
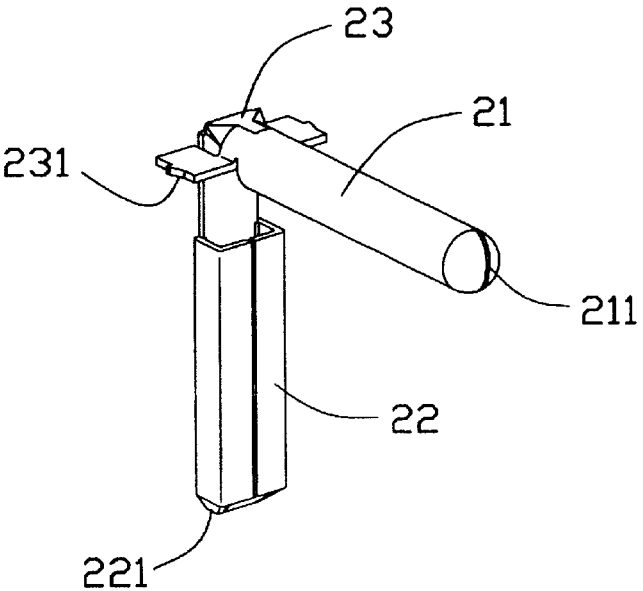
FIGS. 5, 6 and 7 sequentially illustrate the process of forming a central conductive pin of the power jack shown in FIG. 1.
Figure 6:
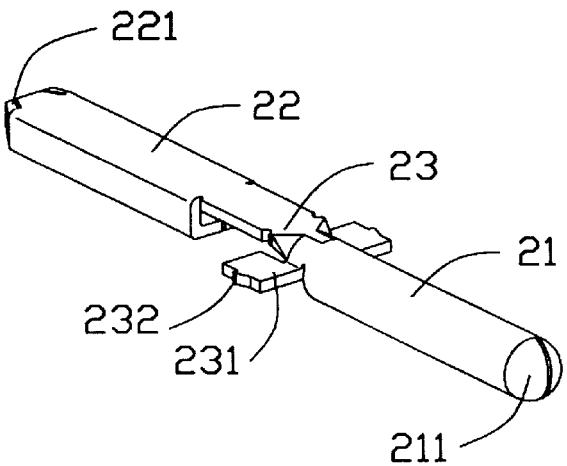
Figure 5:
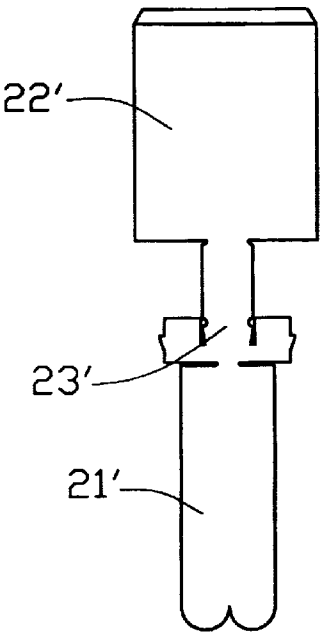

FIGS. 5, 6 and 7 introduce a manufacturing process of the central conductive pin 2 briefly. The central conductive pin 2 is stamped and formed from a metal sheet. The metal sheet is first stamped to obtain the original configuration of the central pin 2 which comprises a contacting section 21', a soldering section 22' and a soldering section 23', as shown in FIG. 5. The expanded contacting section 21' is then rolled and configured into a hollow column-shaped contacting section 21 with a round contacting end 211 being formed at a free end thereof, and the expanded soldering section 22' is bent and configured into a hollow cuboid-shaped soldering section 22, as shown in FIG. 6. Finally, the expanded intermediate section 23' is bent along a rear side of the two wings 231 to obtain a final central pin 2 as shown in FIG. 7.

In assembly, the contacting arm 42 of the second switch contact 4 is inserted into the elongated chamber 141 through the upper cutout 163 of the sidewall 16, with the enlarged portion 421 being received in the slit 161 opposite the upper cutout 163, with the pair of lugs 422 being respectively retained in corresponding cavities of the sidewalls 16, and with an upper portion of the retaining leg 43 abutting against an outer surface of the sidewall 16 and a lower portion thereof extending beyond the bottom wall 15. The first switch contact 3 is then received in the elongated chamber 141 with the resilient tab 320 being retained in the rectangular hole 152 with the pair of retaining portions 321 being retained in the corresponding channels 162, and with an upper end of the retaining leg 322 engaging with the lower cutout 164. At the same time, the contacting fingers 312 of the resilient portion 31 resiliently contact with the contacting arm 42 of the second switch contact 4 thus to establish an electrical connection therebetween. Finally, the contacting section 21 of the central conductive pin 2 is accommodated in the cavity 130 in alignment with axis of the plug insertion hole 12 for correctly and properly mating with the mating plug 5. The pair of wings 231 of the central conductive pin 2 are respectively received in the pair of slots 131 and the intermediate section 23 is downwardly received in the groove 17 of the insulating housing 1. The soldering section 22 of the central conductive pin 2 extends through the lower recess 14 and the rectangular groove 151 and beyond the bottom wall 15 to engage with the hole of the printed circuit board.

Figure 8:
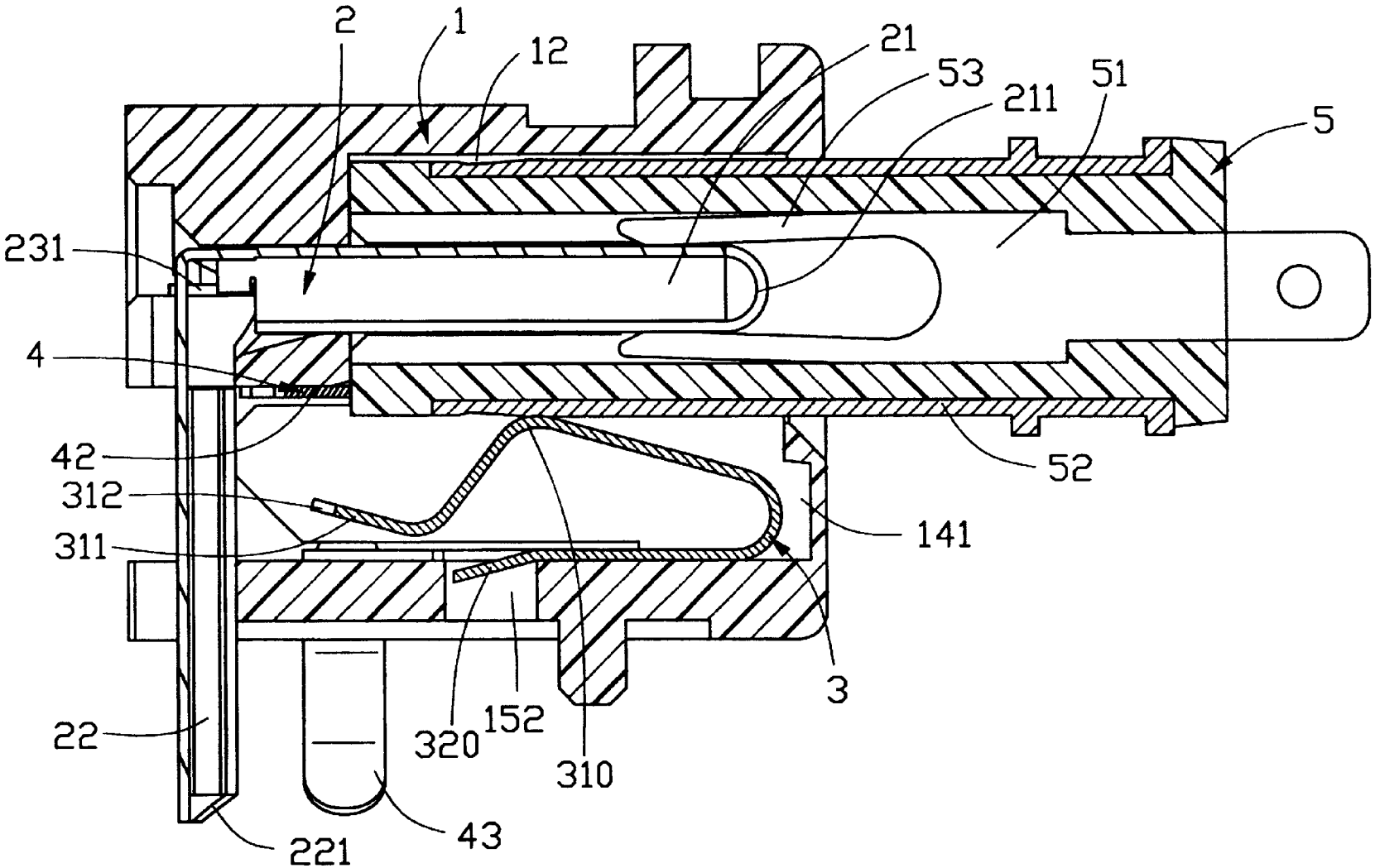
FIG. 8 is a cross-sectional view of the power jack, with a mating connector connected therewith.
Figure 9:
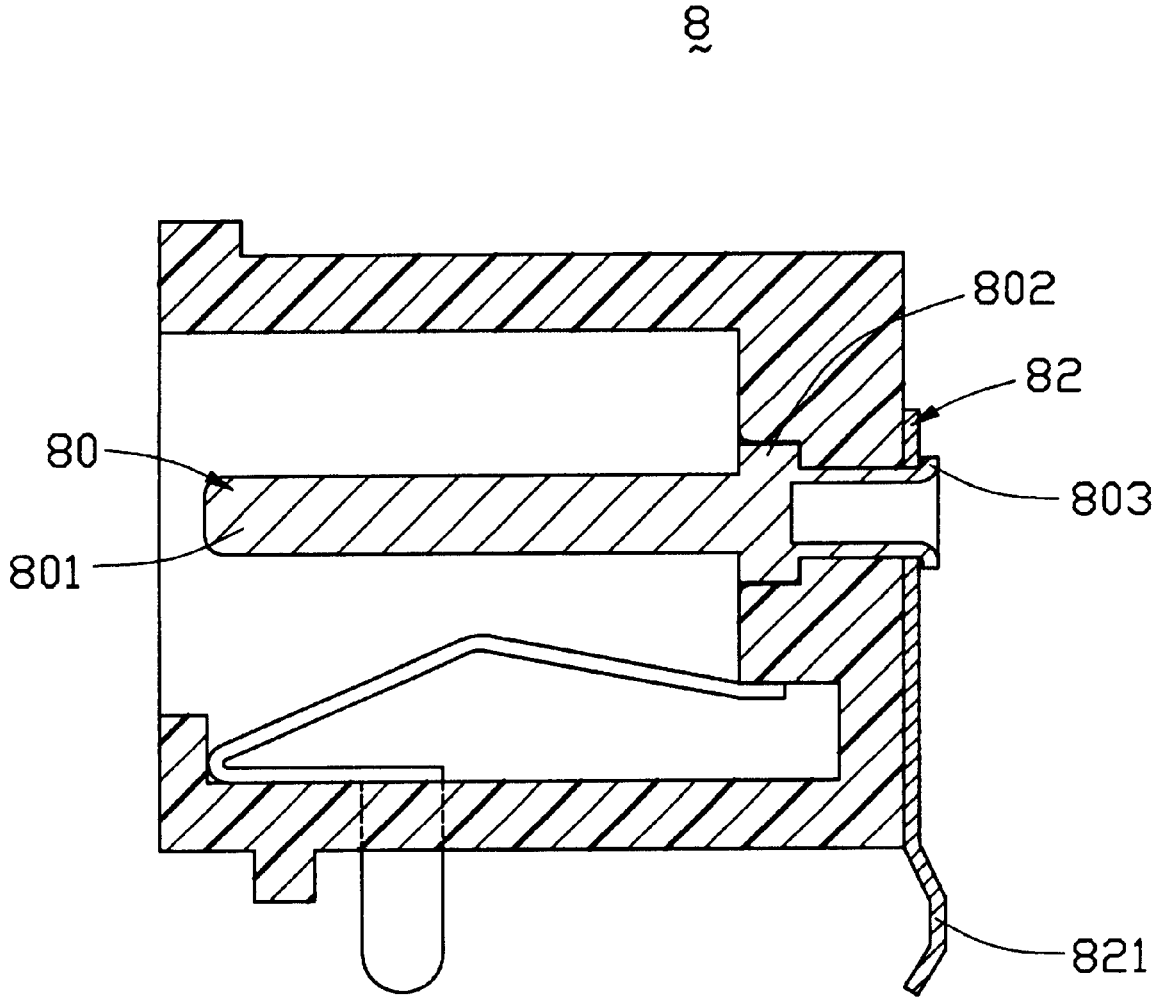
FIG. 9 (PRIOR ART)
FIG. 9 is a cross-sectional view of a conventional power jack using a first kind of central pin.
Figure 10:
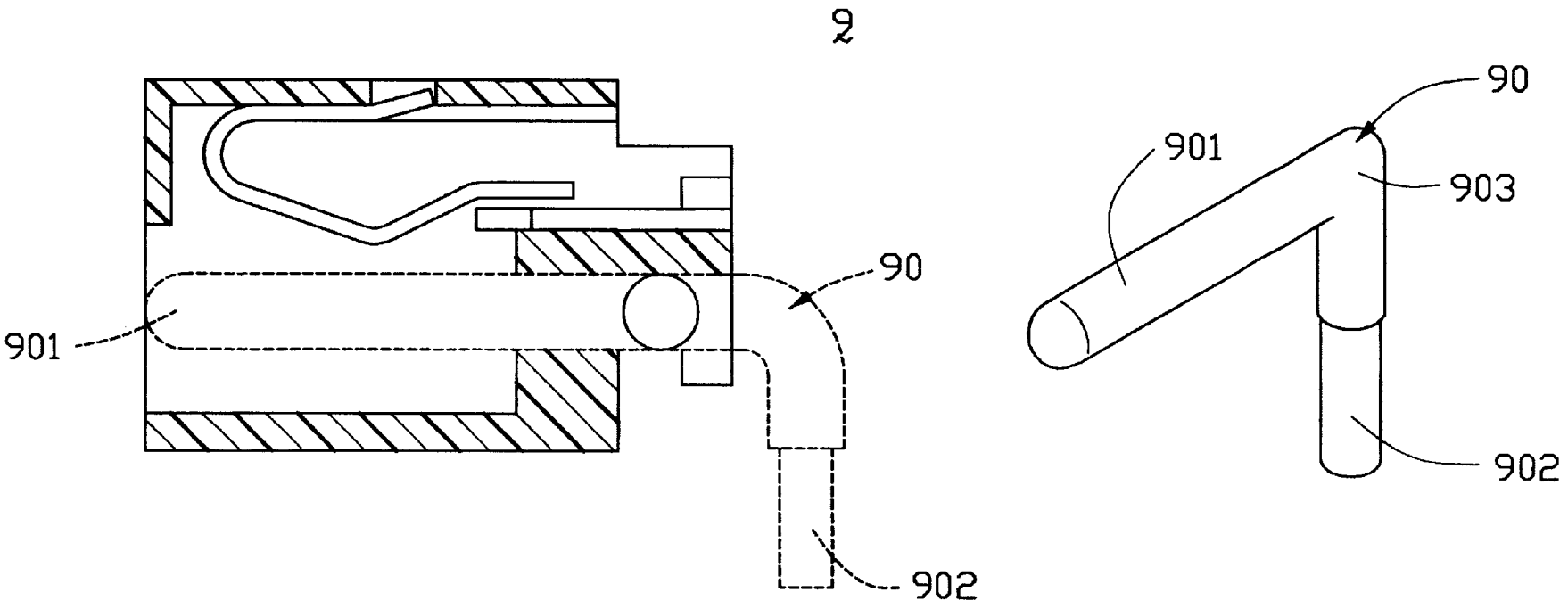
FIG. 10 (PRIOR ART)
FIG. 10 is a cross-sectional view of a conventional power jack using a second kind of central pin.

In use, referring to FIG. 8, the mating plug 5 with a conductive terminal 51 is inserted into the plug insertion hole 12 of the insulating housing 1. An outer shield 52 of the mating plug 5 presses against the inverted V-shaped portion 310 of the first switch contact 3 and obliges the contacting fingers 312 to disengage from the contacting arm 42 of the second switch contact 4, whereby a mechanical and conductive engagement between the outer shield 52 of the mating plug 5 and the first switch contact 3 of the power jack is obtained. Simultaneously, the conductive terminal 51 of the mating plug 5 has a bifurcated mating end 53 electrically engaging with the contacting portion 21 of the central conductive pin 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power jack for mating with a mating plug comprising:

an insulating housing having a front face, a rear face opposite to the front face, a plug insertion hole defined through the front face, an upper recess and a lower recess both defined in the rear face, a groove communicating the upper recess with the lower recess, an elongated cavity communicating the upper recess with the plug insertion hole, an elongated chamber communicating with the lower recess and the groove, and a pair of slots on opposite sides of the elongated cavity and in communication with the groove;

a first switch contact substantially received in the elongated chamber;

a second switch contact fixed to the insulating housing and partially received in the elongated chamber, the first switch contact being movable to electrically contact with said second switch contact by a mating plug; and an one-piece central conductive pin comprising a hollow contacting portion received in said elongated cavity and in alignment with said plug insertion hole, a soldering portion vertically extending through said lower recess and engaged with the insulating housing, and an intermediate portion connecting said contacting portion and said soldering portion, said intermediate portion being substantially received in said groove and comprising a pair of wings, the pair of wings extending from opposite sides thereof and being retained in said pair of slots.

2. The power jack as described in claim 1, wherein each of said wings has a barb on a lateral edge thereof for interference fitting with a corresponding slot.

3. The power jack as described in claim 1, wherein said contacting portion of said central conductive pin is configured as a hollow column.

4. The power jack as described in claim 1, wherein said soldering portion of said central conductive pin is configured as a hollow cuboid and has a tapered free end, and said insulating housing includes a bottom wall and a rectangular groove defined in a rear side of said bottom wall for extension of said tapered free end of said soldering portion therethrough and for retaining said soldering portion.

5. The power jack as described in claim 1, wherein said first switch contact comprises a base portion and a resilient portion extending rearwards from a front edge of said base portion, both said base portion and said resilient portion being received in said elongated chamber.

6. The power jack as described in claim 5, wherein said resilient portion has an inverted V-shaped portion and a contacting portion formed at a free end thereof, said contacting portion having a pair of contacting fingers resiliently and conductively engagable with said first switch contact.

7. The power jack as described in claim 5, wherein said base portion has a downwardly extending resilient tab, and said insulating housing defines a rectangular hole for receiving said resilient tab.

8. The power jack as described in claim 5, wherein said base portion comprises a pair of retaining portions horizontally projecting form opposite lateral sides thereof, and said insulating housing defines a pair of opposite channels interconnected by said elongated chamber for respectively receiving said pair of retaining portions.

9. The power jack as described in claim 5, wherein said base portion has a retaining leg projecting from a lateral rear edge thereof and extending downwardly, and said insulating housing defines a lower cutout in communication with said elongated chamber for outward extension of said retaining leg.

10. The power jack as described in claim 1, wherein said second switch contact comprises a contacting arm substantially received in the elongated chamber, a retaining leg extending downwardly along an outer surface of said insulating housing, and a bent-out transition portion connecting said contacting arm and said retaining leg.

11. The power jack as described in claim 10, wherein said insulating housing defines an upper cutout in said outer surface in communication with said elongated chamber for receiving said transition portion.

12. The power jack as described in claim 11, wherein said contacting arm has an enlarged portion at a free end thereof and a pair of lugs separately protruding forwards from a front edge thereof, and said insulating housing defines a slit opposite to said upper cutout for receiving said enlarged portion and a pair of cavities respectively communicating with said upper cutout and said slit for interference fitting said pair of lugs therein.

13. The power jack as described in claim 10, wherein said contacting arm electrically contacts with said first switch contact prior to insertion of the mating plug.

* * * * *